US011821194B2

(12) United States Patent
Alvarez

(10) Patent No.: US 11,821,194 B2
(45) Date of Patent: Nov. 21, 2023

(54) ARCH BUILDING STRUCTURE

(71) Applicant: Francisco Javier Alvarez, El Paso, TX (US)

(72) Inventor: Francisco Javier Alvarez, El Paso, TX (US)

( * ) Notice: Subject to any disclaimer, the term of this patent is extended or adjusted under 35 U.S.C. 154(b) by 31 days.

(21) Appl. No.: 17/509,845

(22) Filed: Oct. 25, 2021

(65) Prior Publication Data

US 2022/0127839 A1 Apr. 28, 2022

Related U.S. Application Data

(63) Continuation-in-part of application No. 29/808,664, filed on Sep. 22, 2021.

(60) Provisional application No. 63/106,272, filed on Oct. 27, 2020.

(51) Int. Cl.

| | |
|---|---|
| ***E04C 3/42*** | (2006.01) |
| ***E04B 7/08*** | (2006.01) |
| ***E04B 1/32*** | (2006.01) |

(52) U.S. Cl.

CPC ..... *E04B 1/3205* (2013.01); *E04B 7/08* (2013.01); *E04C 3/42* (2013.01); *E04B 2001/3241* (2013.01)

(58) Field of Classification Search

CPC ..... E04C 3/38; E04C 3/42; E04B 7/08; E04B 7/10; E04B 7/102; E04B 7/105; E04B 7/12; E04B 7/20; E04B 2001/2636; E04B 2001/2644; E04B 2001/2648; E04B 2001/2672; E04B 2001/268; E04B 2001/2684; E04B 2001/2692; E04B 2001/3235; E04B 2001/3241; E04B 2001/3252; E04B 2001/3294; E04B 1/32; E04B 1/3205; E04B 1/3211; E04B 1/19; E04B 1/26; E04B 1/2604; E04B 1/2608; E04B 1/2612

See application file for complete search history.

(56) References Cited

U.S. PATENT DOCUMENTS

| | | | | |
|---|---|---|---|---|
| 2,350,904 A * | 6/1944 | King | E04B 1/3445 | 52/285.4 |
| 2,638,637 A * | 5/1953 | Kump, Jr. | E04C 3/42 | 52/690 |
| 3,494,082 A * | 2/1970 | Adams | E04B 1/3205 | 52/520 |
| 3,985,459 A * | 10/1976 | Gilb | E04C 3/292 | 52/696 |
| 4,156,433 A * | 5/1979 | Beaulieu | E04B 1/3441 | 52/109 |

(Continued)

FOREIGN PATENT DOCUMENTS

EP 0014144 A1 8/1980

*Primary Examiner* — Jessica L Laux

(57) ABSTRACT

An arch building structure includes a plurality of structural arch assemblies, a plurality of purlins, and a plurality of flat roofing sections. The plurality of structural arch assemblies is positioned parallel and offset from each other upon the length of the building. The plurality of purlins is positioned perpendicular to the plurality of structural arch assemblies and radially positioned on the vertexes of the plurality of structural arch assemblies to further strengthen the building. Each of the plurality of flat roofing sections is mounted across a corresponding pair of adjacent purlins from the plurality of purlins so that the building roof can be completed.

11 Claims, 14 Drawing Sheets

(56) References Cited

U.S. PATENT DOCUMENTS

| | | | | | |
|---|---|---|---|---|---|
| 4,373,305 | A | | 2/1983 | Russell | |
| 4,412,405 | A | * | 11/1983 | Tucker | E04B 1/3205 52/643 |
| 5,309,693 | A | | 5/1994 | Harding | |
| 5,363,627 | A | * | 11/1994 | Wilson | E04H 7/02 135/122 |
| 6,141,934 | A | | 11/2000 | Zeigler | |
| 8,910,428 | B2 | * | 12/2014 | Rule | E04B 1/34315 52/79.5 |
| 10,774,519 | B2 | * | 9/2020 | Tucker | E04B 1/32 |
| 2008/0006001 | A1 | | 1/2008 | Esteverena | |
| 2019/0360232 | A1 | | 11/2019 | Carter | |
| 2020/0109552 | A1 | | 4/2020 | Tucker | |
| 2020/0190844 | A1 | | 6/2020 | Ribner | |

* cited by examiner

ARCH BUILDING STRUCTURE

The current application claims a priority to the U.S. Provisional Patent application Ser. No. 63/106,272 filed on Oct. 27, 2020.

FIELD OF THE INVENTION

The present invention relates generally to a building structure. More specifically, the present invention is an arch building structure that can form a barrel vault. The present invention is specifically designed to form a barrel vault that has a semi-hexadecagon shape.

BACKGROUND OF THE INVENTION

A barrel vault, also known as a tunnel vault or wagon vault, is an architectural element formed by a continuation of arches placed side by side (i.e., one after another) along a given distance lending a semi-cylindrical appearance to the total design. The barrel vault is the simplest form of a vault: effectively a series of arches placed side by side (i.e., one after another). However, several drawbacks are associated with the existing barrel vault design. For example, a typical barrel vault usually requires specifically designed roofing panels, increasing the total cost of construction. Moreover, people usually find it expensive, time-consuming, and inefficient to build a barrel vault. The present invention aims to solve some of these problems by disclosing a novel arch building structure that forms a barrel vault.

It is an objective of the present invention to provide an easy to assemble arch building structure. The present invention utilizes a plurality of brackets or connectors and existing dimensional lumber to easily construct a structural arch. Then, multiple structural arches are positioned offset of each other according to the desired length of the building. Then, multiple roofing sections are mounted onto the purlins that extend along and atop the structural arches. As a result, the present invention can assemble a system to construct a barrel vault in an easy and inexpensive manner.

SUMMARY OF THE INVENTION

The present invention is designed to form a barrel vault. The formed barrel vault can utilize standard roofing panels that are readily available in the market. The present invention comprises a plurality of specifically designed brackets or connectors that facilitates constructing the barrel vault. The present invention can reduce the number of arches by spacing them, at intervals, with longitudinal elements. Therefore, reducing the cost of the structure significantly. The present invention transforms commercially available natural and plastic wood materials, with nominal dimensions, into a barrel vault without significant modification. More specifically, the invention comprises metal brackets or connectors that facilitate the anchorage, course deflection and cross connection of straight and flat pieces of wood and lumber panels to form the arches and longitudinal frames of a barrel vault. These brackets or connectors are simple in structure, affordable to manufacture, and easy to use.

DETAIL DESCRIPTIONS OF THE INVENTION

All illustrations of the drawings are for the purpose of describing selected versions of the present invention and are not intended to limit the scope of the present invention.

Figure 1:
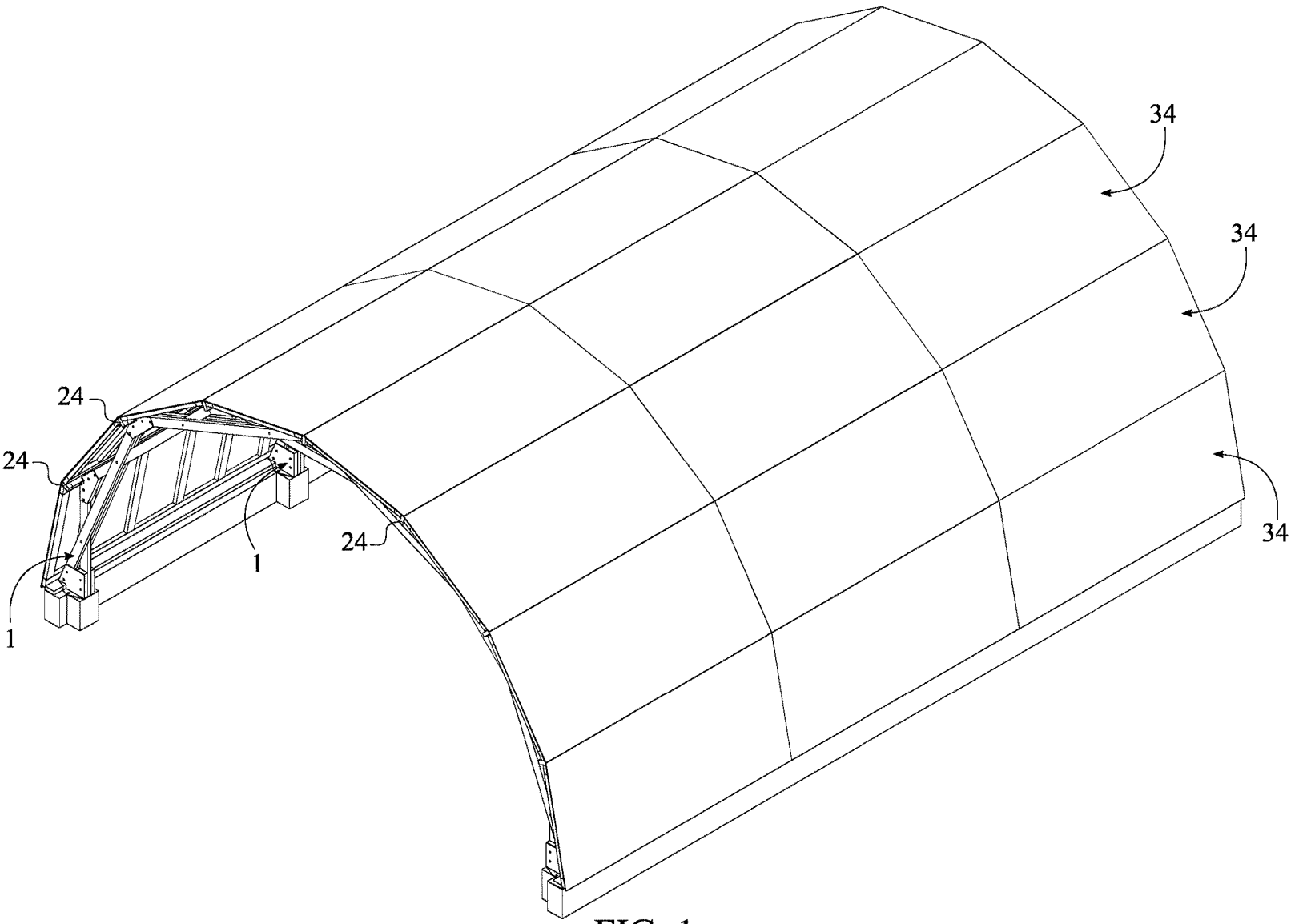
FIG. 1 is a top perspective view of the present invention, wherein the arch building is completed.
Figure 2:
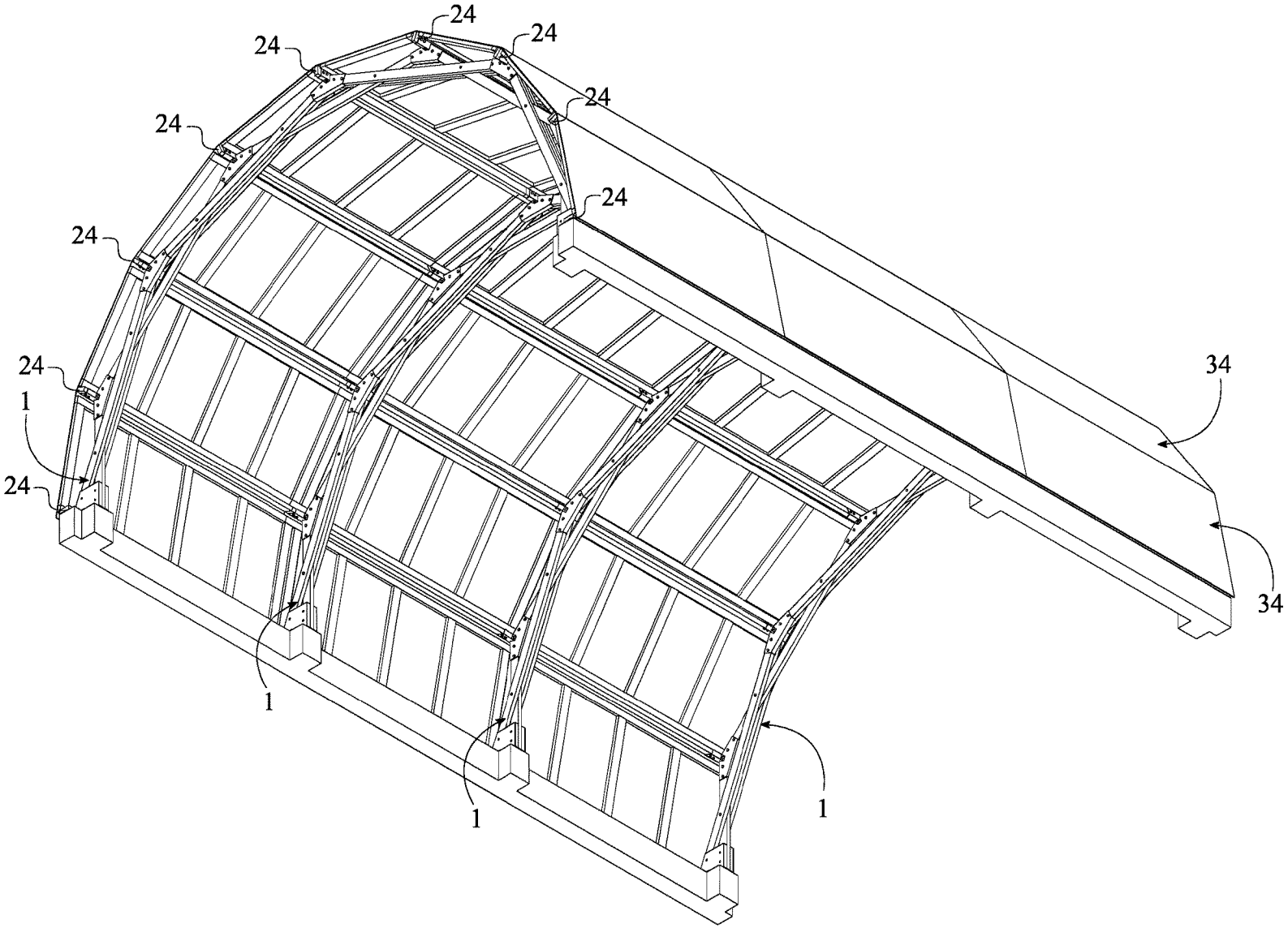
FIG. 2 is a bottom perspective view of the present invention, wherein the arch building is completed.
Figure 3:
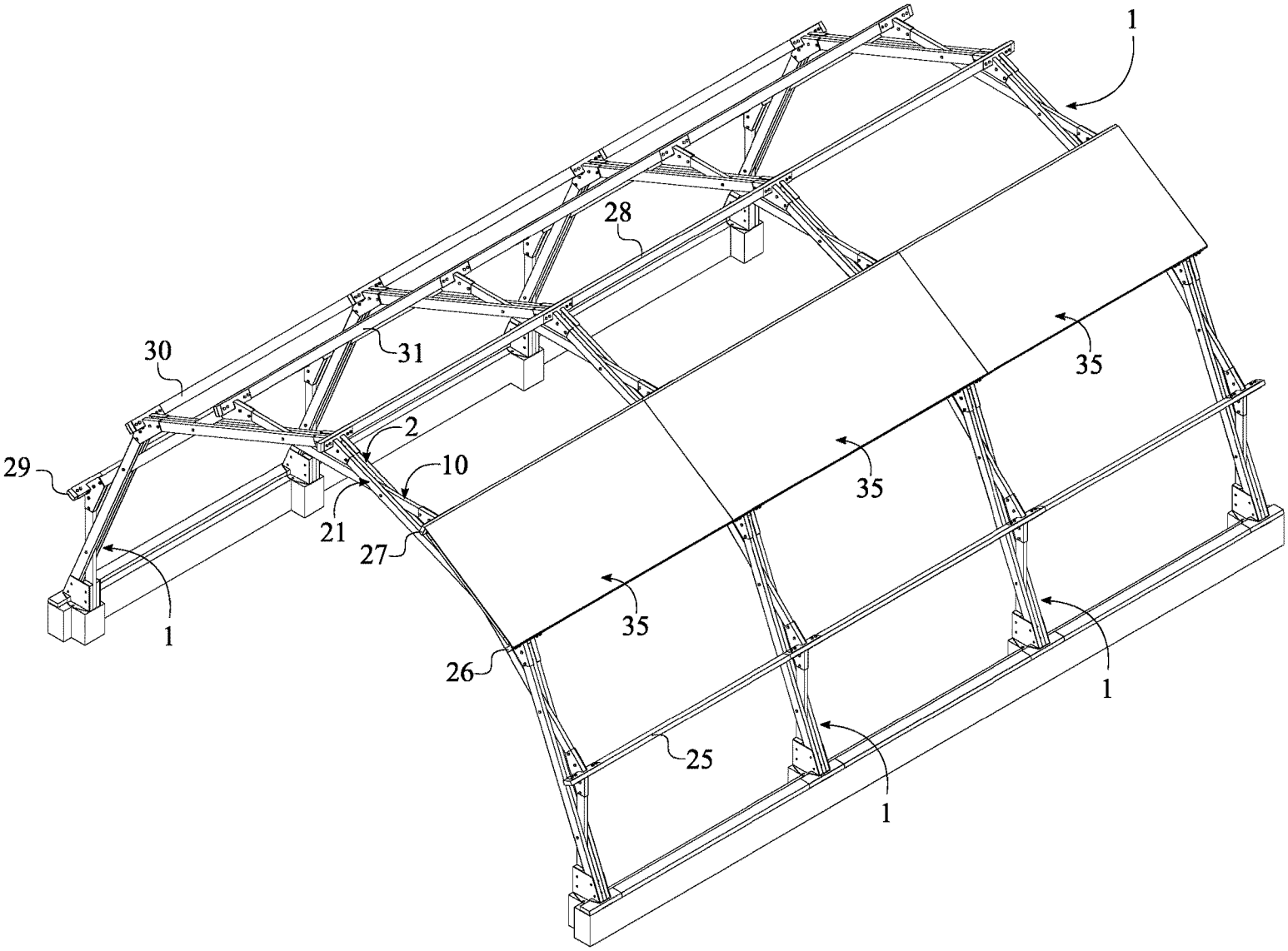
FIG. 3 is a top perspective view of the present invention, showing only one of the plurality of flat roofing sections.

In reference to FIGS. 1-3, the present invention is an arch building structure that is used to form a barrel vault. It is an aim of the present invention to provide an arch building structure that can form a barrel vault. It is another aim of the present invention to provide a plurality of connectors that connect the structural members together. It is yet another aim of the present invention to produce a barrel vault of unique shape.

In reference to FIG. 1-3, the present invention comprises a plurality of structural arch assemblies 1, a plurality of purlins 24, and a plurality of flat roofing sections 34. The plurality of structural arch assemblies 1 is a composition of multiple truss type structures in the form of a semi hexadecagon. More specifically, each of the plurality of structural arch assemblies 1 comprises a first truss 2, a second truss 10, and a third truss 21 as the second truss 10 is sandwiched in between the first truss 2 and the third truss 21. The plurality of purlins 24 is a longitudinal member and mounted to the plurality of structures thus providing the length of the building. The plurality of purlins 24 comprises a first left purlin 25, a second left purlin 26, a third left purlin 27, a ridge purlin 28, a first right purlin 29, a second right purlin 30, and a third right purlin 31 so that each vertex of the plurality of structural arch assemblies 1 can be mounted in the lengthwise direction. The plurality of flat roofing sections 34 is mounted to the plurality of purlins 24 to form the roof of the building.

In reference to the general configuration of the present invention, as shown in FIGS. 1-3 and FIG. 8, the plurality of structural arch assemblies 1 is positioned parallel and offset from each other so that the length of the building can be determined. Furthermore, the space between a pair of arches from the plurality of structural arch assemblies 1 is considered as a bay. To comply with the structural integrity of the building, any building needs to have minimum of four structural arch assemblies 1 composing three bays. The plurality of purlins 24 is positioned perpendicular to the plurality of structural arch assemblies 1 and radially positioned about the plurality of structural arch assemblies 1. As a result, the first left purlin 25, the second left purlin 26, the third left purlin 27 are symmetrically positioned to the first right purlin 29, the second right purlin 30, the third right purlin 31 about the ridge purlin 28 that is the highest purlin of the building. More specifically, the ridge purlin 28 is mounted to the first truss 2 and the third truss 21 through a ridge connector 3 of the first truss 2 and the third truss 21. The first left purlin 25, the third left purlin 27, the first right purlin 29, and the third right purlin 31 are mounted to the second truss 10 through a plurality of channeled arch connectors 11 of the second truss 10. Each of the plurality of channeled arch connectors 11 of the second truss 10 comprises an interior channel 112 and a central notch 114. The second left purlin 26 and the second right purlin 30 are mounted to the first truss 2 and the third truss 21 through a left arch connector 4 and a right arch connector 5 of the first truss 2 and the third truss 21. Each of the ridge connector 3, the left arch connector 4 and the right arch connector 5 of the first truss 2 and the third truss 21 comprises a channel 302 and a central notch 304. Each of the plurality of flat roofing sections 34 is mounted across a corresponding pair of adjacent purlins from the plurality of purlins 24 so that the roof of the building can be completed.

Figure 6:
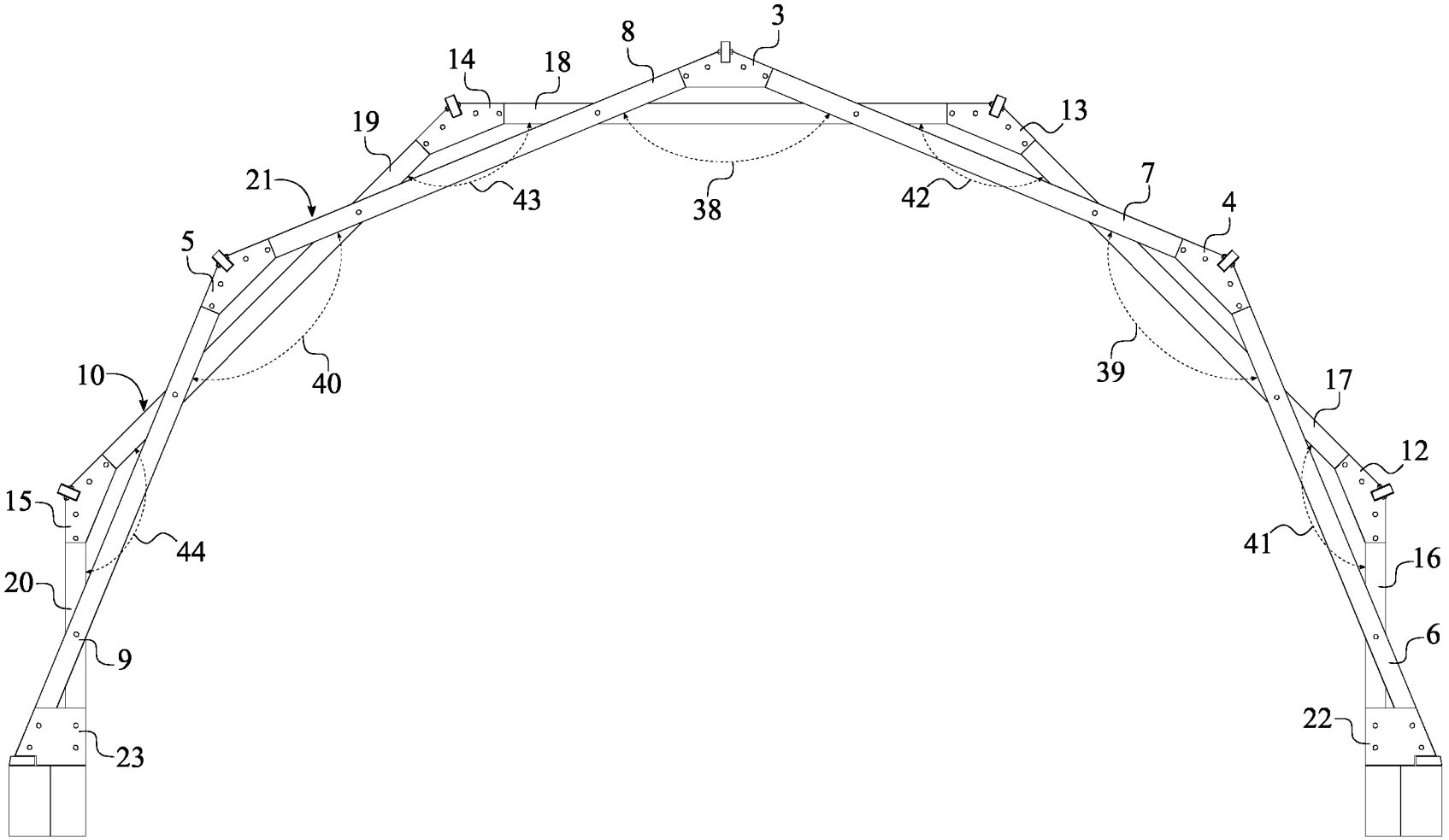
FIG. 6 is a front view of the present invention showing the second truss and the third truss.
Figure 7:
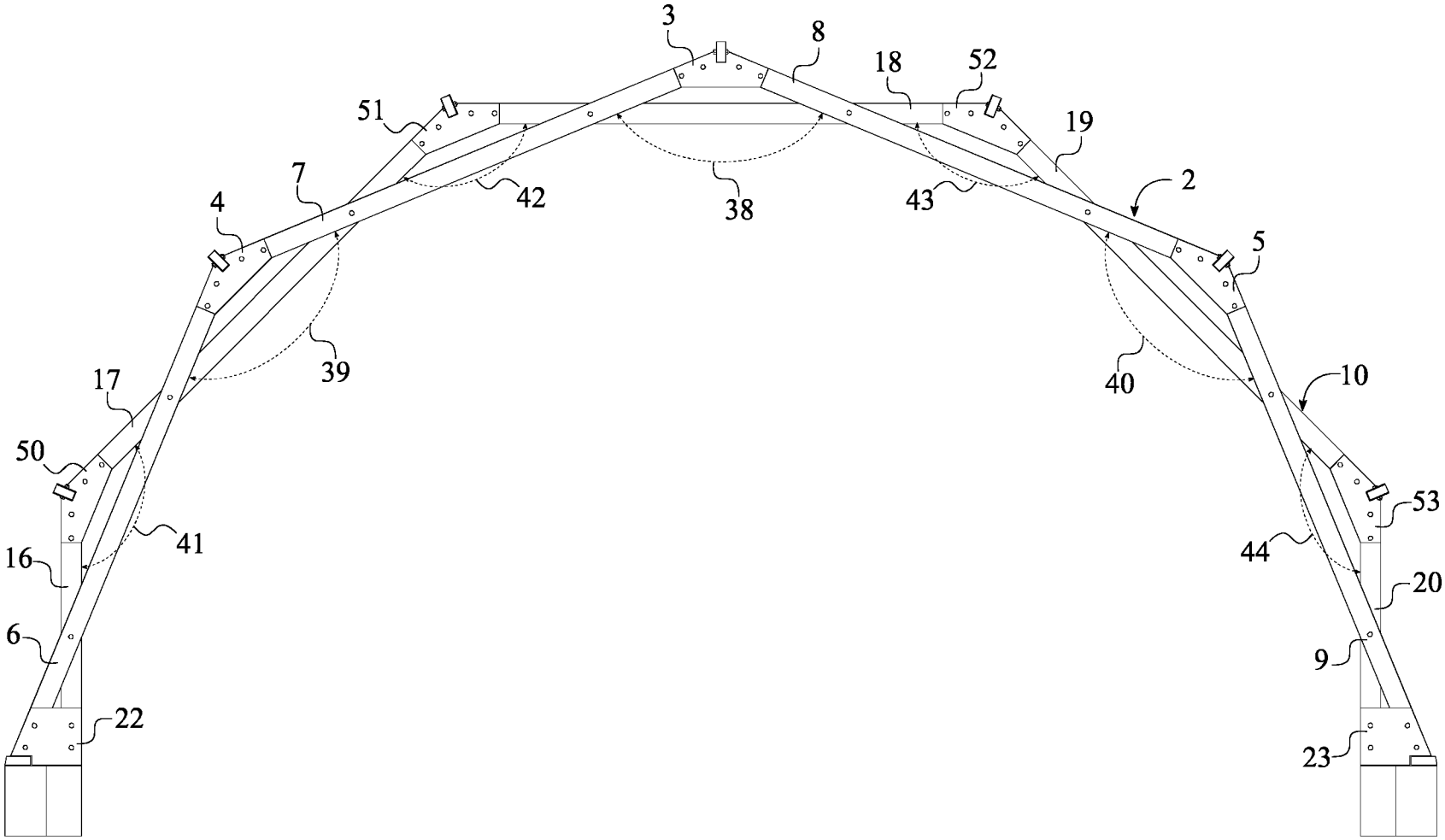
FIG. 7 is a rear view of the present invention showing the second truss and the first truss.
Figure 8:
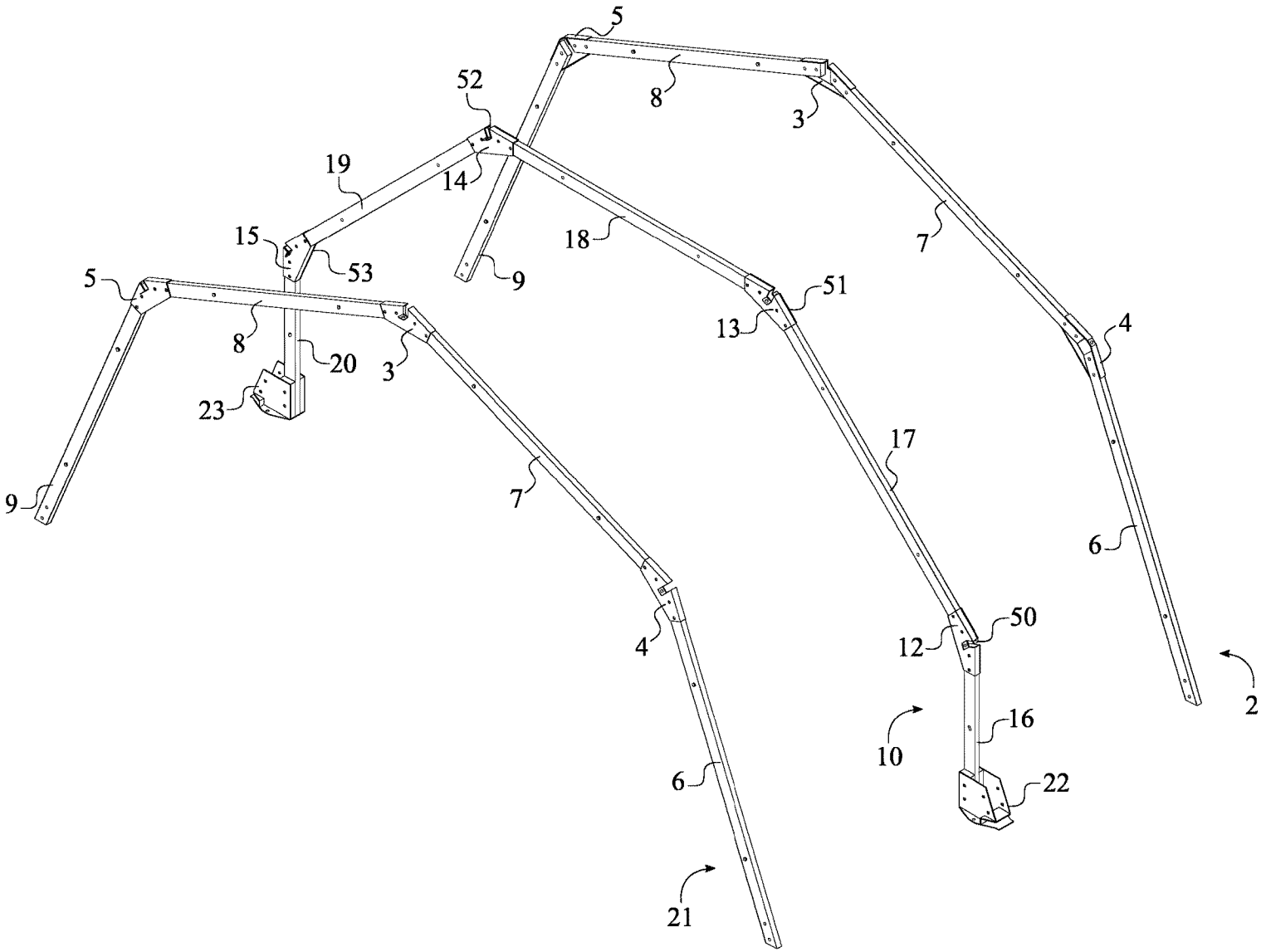
FIG. 8 is an exploded view of each of the plurality of arch assemblies.
Figure 9:
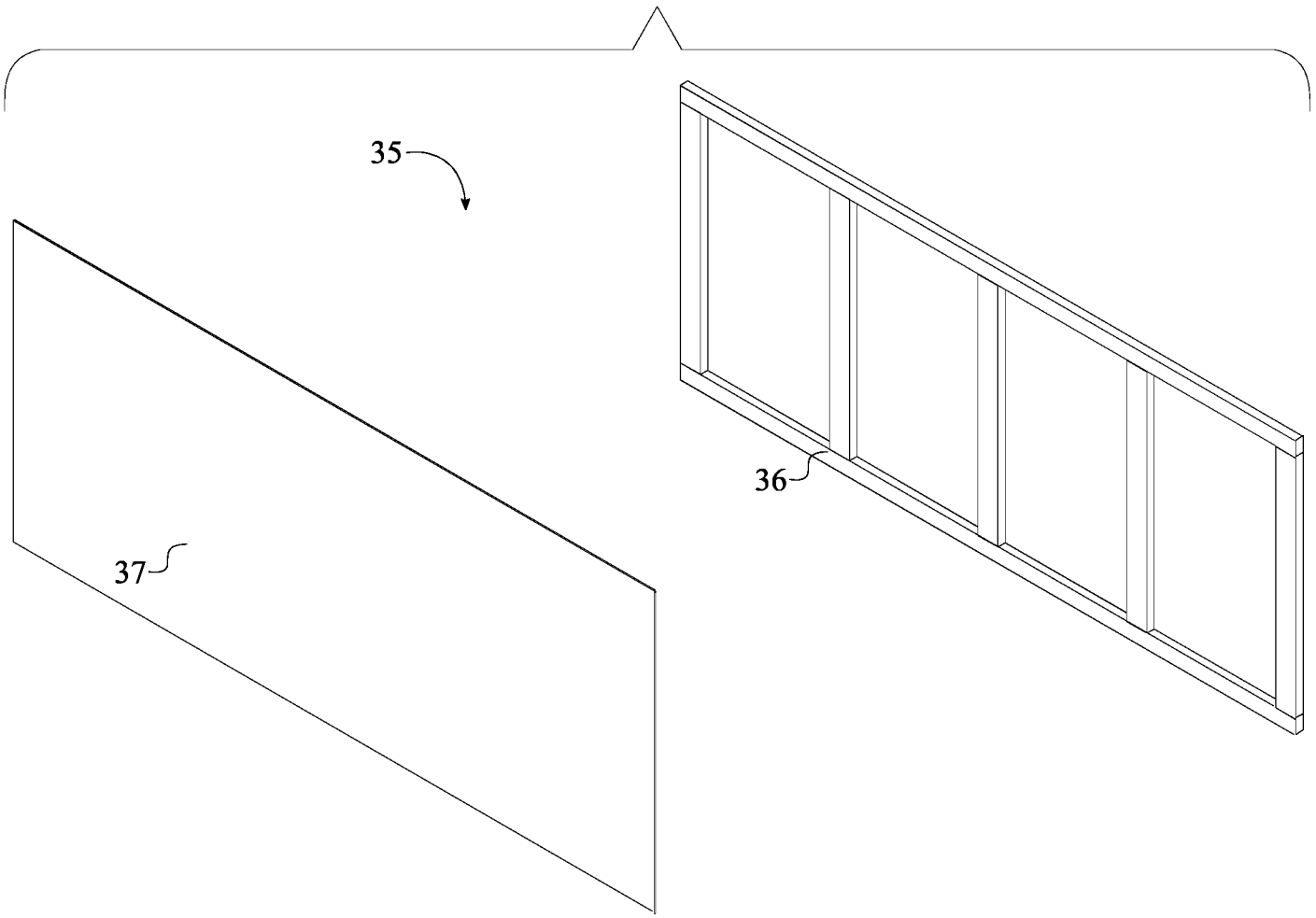
FIG. 9 is an exploded view of the each of the plurality of roof panels.

As shown in FIGS. 6-7 and FIG. 12-13, the first truss 2 and the third truss 21 each further comprises a left base chord 6, a left top chord 7, a right top chord 8, and a right base chord 9. The left top chord 7 and the right top chord 8 are oppositely positioned of each other about the ridge connector 3 and angularly mounted to the ridge connector 3. The left arch connector 4 and the ridge connector 3 are oppositely positioned of each other about the left top chord 7 as the left top chord 7 is angularly mounted to the left arch connector 4. As a result, the left base chord 6 and the left top chord 7 are oppositely positioned of each other about the left arch connector 4 thus enabling the left base chord 6 to be angularly mounted to the left arch connector 4. Similarly, the right arch connector and the ridge connector 3 are oppositely positioned of each other about the right top chord 8 as the right top chord 8 is angularly mounted to the right arch connector 5. As a result, the right base chord 9 and the right top chord 8 are oppositely positioned of each other about the right arch connector 5 so that the right base chord 9 can be angularly mounted to the right arch connector 5. As shown in FIG. 7, the left base chord 6 and the right base cord function as terminal ends to secure the first truss 2 and the third truss 21 onto a base platform.

The first truss 2 and the third truss 21 each preferably has a dimension of 2 inches in width, 4 inches in height, and 8 feet in length. For example, the left base chord 6, the left top chord 7, the right top chord 8, and the right base chord 9 are 2"×4"×8' dimensional wood or plastic lumber.

The present invention further comprises a first angle 38, a second angle 39, and a third angle 40 so that the semi hexadecagon form for the first truss 2 and the third truss 21 can be delineated. More specifically, the first angle 38 is delineated between the left top chord 7 and the right top chord 8 as the first angle 38 is an obtuse angle. The second angle 39 is delineated between the left top chord 7 and the left base chord 6 as the second angle 39 is an obtuse angle. The third angle 40 is delineated between the right top chord 8 and the right base chord 9 as the third angle 40 is an obtuse angle. Furthermore, the first angle 38, the second angle 39, and the third angle 40 are equal to each other so that the first truss 2 and the third truss 21 can be symmetric about the ridge purlin 28.

As shown in FIG. 6-7, the second truss 10 further comprises a left base chord 16, a left top chord 17, a center top chord 18, a right top chord 19, and a right base chord 20. As shown in FIGS. 14-15 and FIGS. 18-19, the plurality of channeled arch connectors 11 comprises a first connector 12, a first backplate 50, a second connector 13, a second backplate 51, a third connector 14, a third backplate 52, a fourth connector 15, and a fourth backplate 53. The left base chord 16 and the left top chord 17 are oppositely positioned of the right top chord 19 and the right base chord 20 about the center top chord 18 so that the second truss 10 can be symmetric about the center top chord 18. The center top chord 18 is centrally positioned to the ridge connector 3 in order to maintain the offset positioning of the second truss 10 with respect to the first truss 2 and the third truss 21. More specifically, the left base chord 16 and the left top chord 17 are oppositely positioned of each other about the first connector 12, wherein the left base chord 16 and the left top chord 17 are angularly mounted in between the first connector 12 and the first backplate 50. The first connector 12 and the second connector 13 are oppositely positioned of each other about the left top chord 17 as the left top chord 17 is angularly mounted in between the second connector 13 and the second backplate 51. The center top chord 18 and the left top chord 17 being oppositely positioned of each other about the second connector 13 as the center top chord 18 is mounted in between the second connector 13 and the second backplate 51. The second connector 13 and the third connector 14 are oppositely positioned of each other about the left top chord 17 so that the center top chord 18 can also be angularly mounted in between the third connector 14 and the third backplate 52. As a result, the right top chord 19 is angularly mounted in between the third connector 14 and the third backplate 52. The third connector 14 and the fourth connector 15 are oppositely positioned of each other about the right top chord 19, wherein the right top chord 19 is angularly mounted in between the fourth connector 15 and the fourth backplate 53. The right base chord 20 and the right top chord 19 are oppositely positioned of each other about the fourth connector 15 thus enabling the right base chord 20 to be angularly mounted in between the fourth connector 15 and the fourth backplate 53. As shown in FIG. 1, the left base chord 16 and the right base cord function as terminal ends to secure the second truss 10 onto the base platform.

The second truss 10 preferably has a dimension of 2 inches in width, 4 inches in height, and 8 feet in length except for the left base chord 16 and the right base chord 20. For example, the left top chord 17, the center top chord 18, and the right top chord 19 are 2"×4"×8' dimensional lumber. The left base chord 16 and the right base chord 20 are 2"×4"×4' dimensional lumber.

The present invention further comprises a fourth angle 41, a fifth angle 42, a sixth angle 43, and a seventh angle 44 so that the semi hexadecagon form for the second truss can be delineated. More specifically, the fourth angle 41 is delineated between the left base chord 16 and the left top chord 17, wherein the fourth angle 41 is an obtuse angle. The fifth angle 42 is delineated between the left top chord 17 and the center top chord 18, wherein the fifth angle 42 is an obtuse angle. The sixth angle 43 is delineated between the center top chord 18 and the right top chord 19, wherein the sixth angle 43 is an obtuse angle. The seventh angle 44 is delineated between the right top chord 19 and the right base chord 20, wherein the seventh angle 44 is an obtuse angle. Furthermore, the fourth angle 41, the fifth angle 42, the sixth angle 43, and the seventh angle 44 are equal to each other so that the second truss 10 can be symmetric about the ridge purlin 28.

Figure 4:
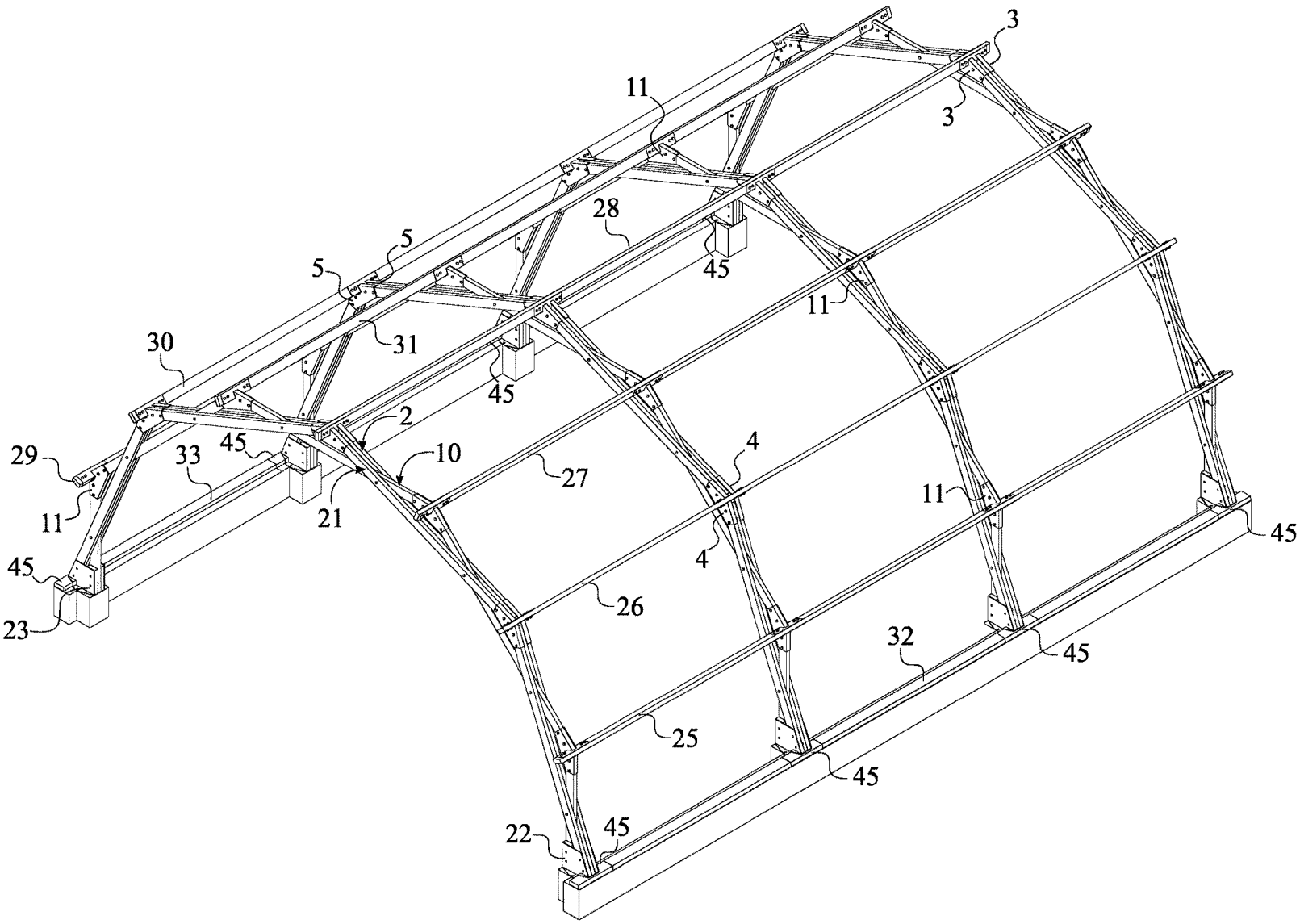
FIG. 4 is a top perspective view of the present invention without showing the plurality of flat roofing sections.
Figure 5:
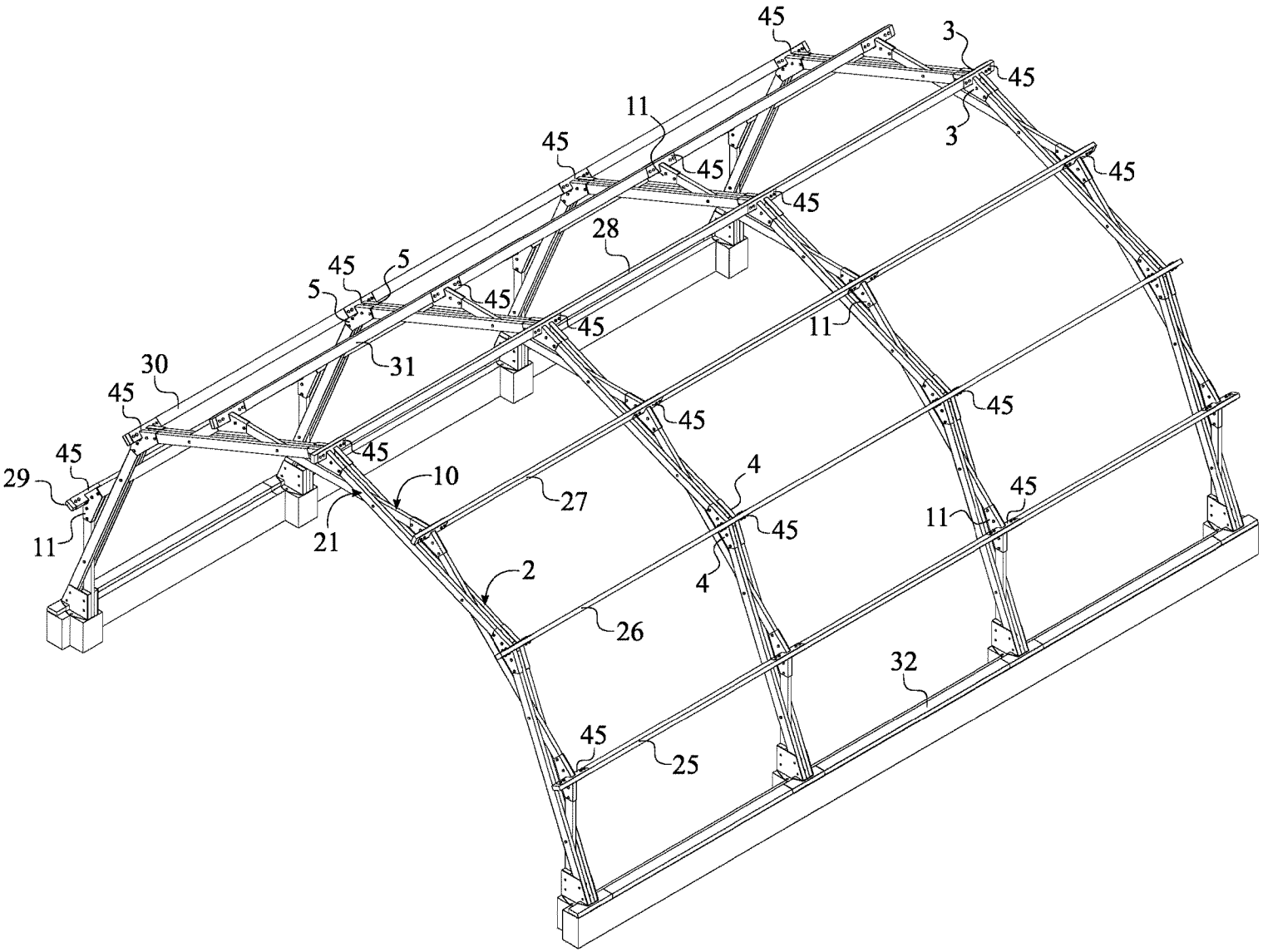
FIG. 5 is another top perspective view of the present invention without showing the plurality of flat roofing sections.
Figure 11:
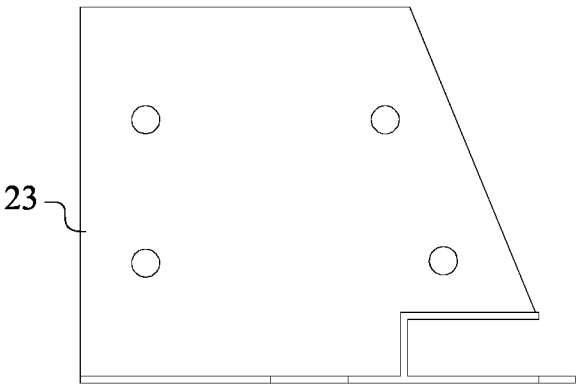
FIG. 11 is a side view of the right anchor base of the present invention.
Figure 10:
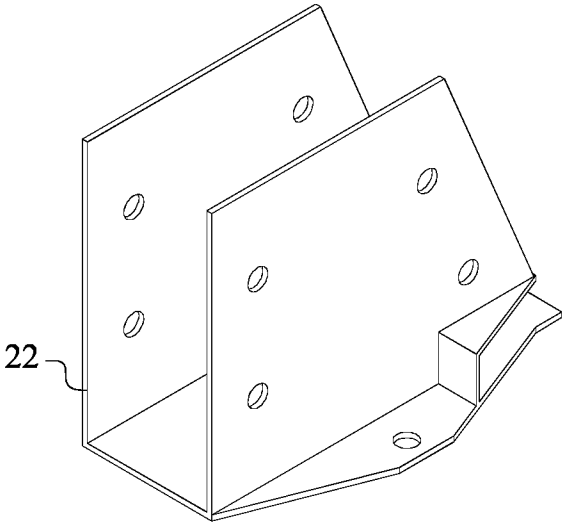
FIG. 10 is a perspective view of the left anchor base of the present invention.
Figure 13:
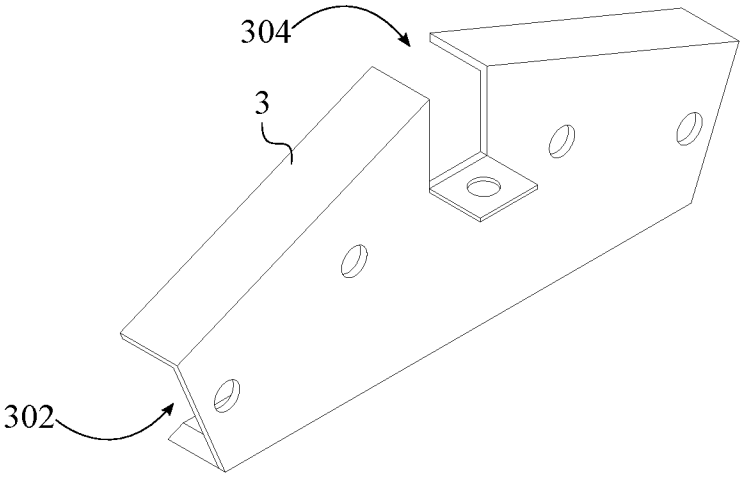
FIG. 13 is a perspective view of the ridge connector of the present invention, wherein the left arch connector and the right arch connector are structurally similar to the ridge connector.
Figure 12:
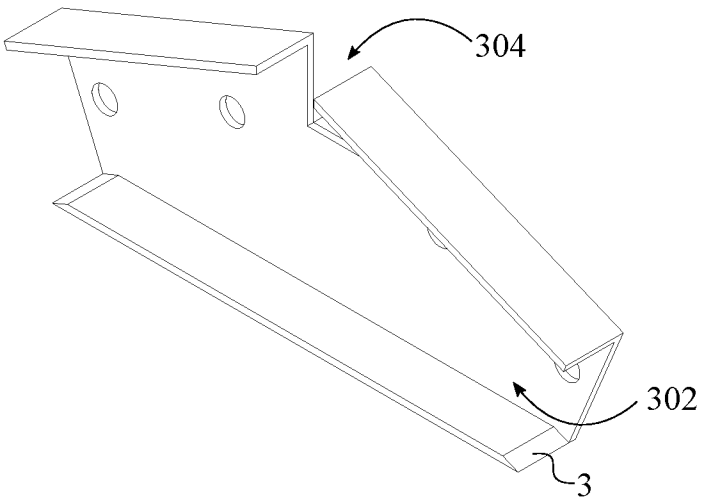
FIG. 12 is a perspective view of the ridge connector of the present invention, wherein the left arch connector and the right arch connector are structurally similar to the ridge connector.
Figure 15:
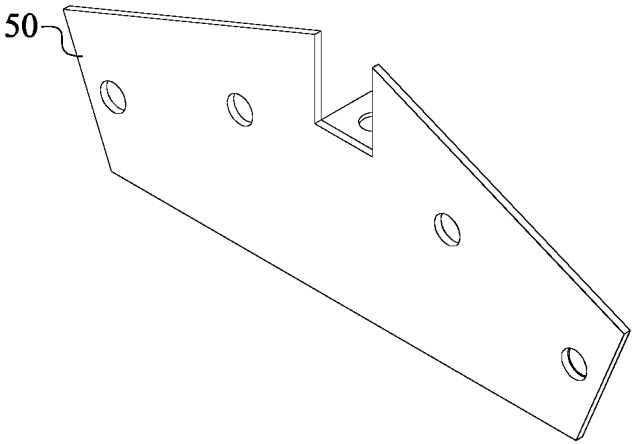
FIG. 15 is a perspective view of the first backplate of the present invention, wherein the second backplate, the third backplate, and the fourth backplate are structurally similar to the first backplate.
Figure 14:
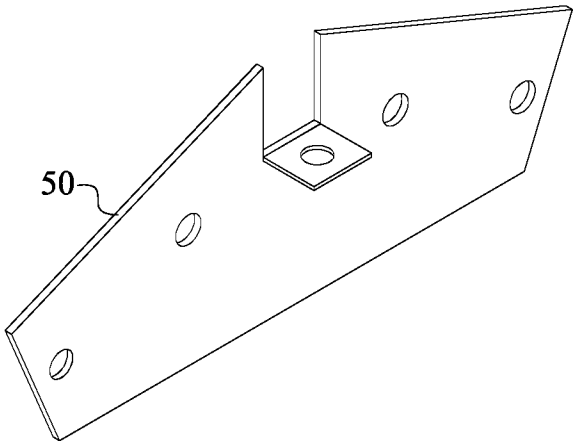
FIG. 14 is a perspective view of the first backplate of the present invention, wherein the second backplate, the third backplate, and the fourth backplate are structurally similar to the first backplate.
Figure 17:
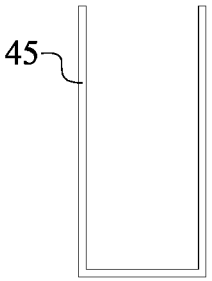
FIG. 17 is a side view of the purlin connector of the present invention.
Figure 16:
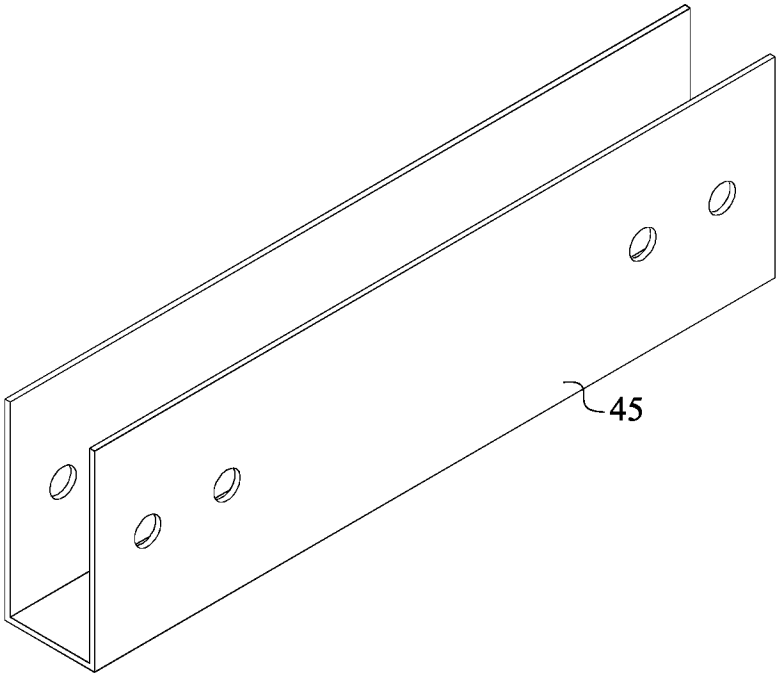
FIG. 16 is a perspective view of the purlin connector of the present invention.
Figure 19:
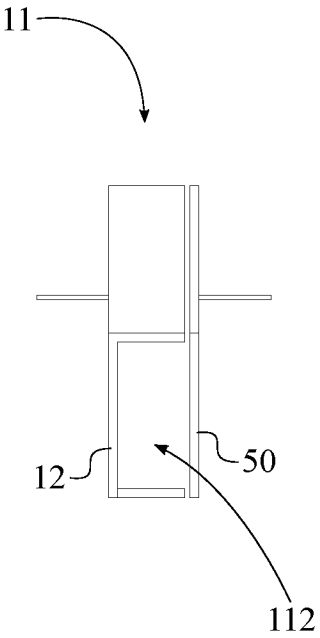
FIG. 19 is a side view of each of the plurality of channeled arch connectors that mount each chord vertex of the second truss within the present invention.
Figure 18:
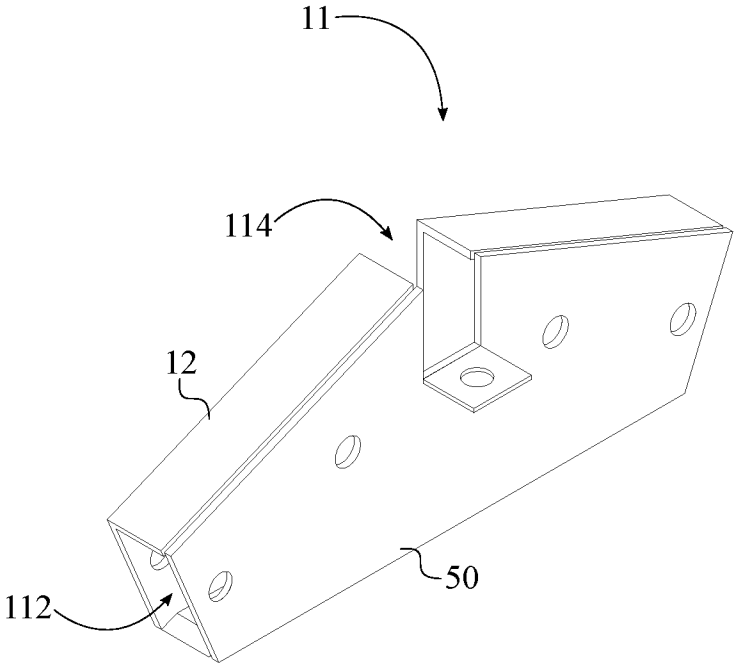
FIG. 18 is a perspective view of each of the plurality of channeled arch connectors that mount each chord vertex of the second truss within the present invention.

In reference to FIG. 4 and FIG. 10-11, each of the plurality of structural arch assemblies 1 further comprises a left anchor base 22 and a right anchor base 23. The left anchor base 22 and the right anchor base 23 provide a solid fixture to mound the terminal ends of the first truss 2, the second truss 10, and the third truss 21 onto the base foundation. Preferably, the left anchor base 22 and the right anchor base 23 each comprises a base plate and a pair of lateral plates that is perpendicularly extended from the base plate to form a channel therebetween. The channel is designed to receive the terminal ends of the first truss 2, the second truss 10, and the third truss 21 so that the left anchor base 22 and the right anchor base 23 can be mounted. The left anchor base 22 and the right anchor base 23 are terminally positioned to the first truss 2, the second truss 10, and the third truss 21. As a result, the first truss 2 and the third truss 21 are angularly mounted to the left anchor base 22 and the right anchor base 23. The second truss 10 is perpendicularly mounted the left anchor base 22 and the right anchor base 23. More specifically, the left base chord 6 for the first truss 2 and the third truss 21 are terminally and angularly mounted to an outer end of the left anchor base 22. The right base chord 9 for the first truss 2 and the third truss 21 are terminally and angularly mounted to an outer end of the right anchor base 23. The left base chord 16 for the second truss 10 is terminally and perpendicularly mounted to an inner end of the left anchor base 22. The right base chord 20 for the second truss 10 is terminally and perpendicularly mounted to an inner end of the right anchor base 23.

In reference to FIG. 4, the plurality of purlins 24 further comprises a left base purlin 32 and a right base purlin 33. The left base purlin 32 is mounted to the left base anchor of each of the plurality of structural arch assemblies 1 so that the left base purlin 32 can extend along the building. The right base purlin 33 is mounted to the right base anchor of each of the plurality of structural arch assemblies 1 so that the right base purlin 33 can also extend along the building. The left base purlin 32 and the right base purlin 33 function as seal between the base foundation and the plurality of structural arch assemblies 1 to keep out unwanted elements away from the inside of the building. Furthermore, the left base purlin 32 and the right base purlin 33 also provide surface area to securely mount the plurality of flat roofing sections 34.

In reference to FIGS. 1-3 and FIG. 9, the plurality of flat roofing sections 34 comprises a plurality of roof panels 35 as the plurality of roof panels 35 is mounted along the corresponding pair of adjacent purlins from the plurality of purlins 24. For example, a specific section of the plurality of flat roofing sections 34 is positioned and mounted along the ridge purlin 28 and the third left purlin 27, wherein the plurality of roof panels of the specific section is positioned and mounted in between each of the plurality of structural arch assemblies 1. In reference to FIG. 1, each roof panel comprises a frame 36 and a cover panel 37. The cover panel 37 is perimetrically positioned flush with the frame 36 and connected to the frame 36, wherein the frame 36 maximizes the structural integrity of the cover panel 37. The frame 36 is mounted along the corresponding pair of adjacent purlins from the plurality of purlins 24 so that the cover panel 37 can function as a roof cover. Preferably, a plurality of roofing clips is configured to mount the frame 36 onto the corresponding pair of adjacent purlins. The plurality of roofing clips fixes each roof panel to the corresponding pair of adjacent purlins which in turn are supported by the plurality of structural arch assemblies 1. The plurality of roofing clips is spaced accordingly to provide anchorage to each roof panel to withstand load and wind factors. The cover panel 37 is preferably made of sheathing panels such as 4'×8'×½" thick plywood, OSB, MDF, sheetrock or any other building panel with these dimensions.

In reference to FIGS. 5-6 and FIGS. 16-17, the present invention further comprises a set of purlin connectors 45. The set of purlin connectors 45 combines a plurality of purlin sections into a singular purlin. For example, the set of purlin connectors 45 mounts multiple purlin bodies into each other so that each of the plurality of purlins 24 can extend along the building as a singular structural body. The set of purlin connectors 45 also mounts the plurality of purlins 24 to the plurality of structural arch assemblies 1. In other words, the set of purlin connectors 45 provides the horizontal continuity and rigidity to the building. More specifically, the set of purlin connectors 45 is equally spaced along each of the plurality of purlins 24 and externally mounted to each of the plurality of purlins 24. The set of purlin connectors 45 of the ridge purlin 28 is mounted to central notch 304 of the ridge connector 3 of the of the first truss 2 and the third truss 21 along the length of the building in order to secure the top end of the plurality of structural arch assemblies 1. The set of purlin connectors 45 of the first left purlin 25, the third left purlin 27, the first right purlin 29, and the third right purlin 31 are mounted to the central notch 114 of the plurality of channeled arch connectors 11 of the of the second truss 10 along the length of the building in order to secure the left side and the right side of the plurality of structural arch assemblies 1. The set of purlin connectors 45 of the second left purlin 26 and the second right purlin 30 are mounted to the central notch 304 of the left arch connector 4 and the central notch 304 of the right arch connector 5 of the first truss 2 and the third truss 21 along the length of the building in order to further secure the left side and the right side of the plurality of structural arch assemblies 1. The set of purlin connectors 45 of the left base purlin 32 is mounted to the left anchor base 22 thus providing a bottom edge for the plurality of flat roofing sections 34 along the first left purlin 25. Similarly, the set of purlin connectors 45 of the right base purlin 33 is mounted to the right anchor base 23 thus providing a bottom edge for the plurality of flat roofing sections 34 along the first right purlin 29.

Although the invention has been explained in relation to its preferred embodiment, it is to be understood that many other possible modifications and variations can be made without departing from the spirit and scope of the invention as hereinafter claimed.

What is claimed is:

1. An arch building structure comprising:
a plurality of structural arch assemblies;
a plurality of purlins;
a plurality of flat roofing sections;
each of the plurality of structural arch assemblies comprising a first truss, a second truss, and a third truss;
the plurality of purlins comprising a first left purlin, a second left purlin, a third left purlin, a ridge purlin, a first right purlin, a second right purlin, and a third right purlin;
the second truss being sandwiched in between the first truss and the third truss;
the first left purlin, the second left purlin, the third left purlin being symmetrically positioned to the first right purlin, the second right purlin, the third right purlin about the ridge purlin;
the plurality of structural arch assemblies being positioned parallel and offset from each other;
the plurality of purlins being positioned perpendicular to the plurality of structural arch assemblies;
the plurality of purlins being radially positioned about the plurality of structural arch assemblies;
the ridge purlin being mounted to the first truss and the third truss through a ridge connector of the first truss and the third truss;
the first left purlin, the third left purlin, the first right purlin, and the third right purlin being mounted to the second truss through a plurality of channeled arch connectors of the second truss;
each of the plurality of channeled arch connectors of the second truss comprising an interior channel and a central notch;
the second left purlin and the second right purlin being mounted to the first truss and the third truss through a left arch connector and a right arch connector of the first truss and the third truss;
each of the ridge connector, the left arch connector, and the right arch connector of the first truss and the third truss comprising a channel and a central notch; and
each of the plurality of flat roofing sections being mounted across a corresponding pair of adjacent purlins from the plurality of purlins.

2. The arch building structure as claimed in claim 1 comprising:
each of the plurality of structural arch assemblies comprising a left anchor base and a right anchor base;
the left anchor base and the right anchor base being terminally positioned to the first truss, the second truss, and the third truss;
the first truss and the third truss being angularly mounted to the left anchor base and the right anchor base; and
the second truss being perpendicularly mounted the left anchor base and the right anchor base.

3. The arch building structure as claimed in claim 1 comprising:
each of the plurality of structural arch assemblies further comprising a left anchor base and a right anchor base;
the plurality of purlins comprising a left base purlin and a right base purlin;
the left base purlin being mounted to the left base anchor of each of the plurality of structural arch assemblies; and
the right base purlin being mounted to the right base anchor of each of the plurality of structural arch assemblies.

4. The arch building structure as claimed in claim 1 comprising:
the plurality of flat roofing sections comprising a plurality of roof panels; and
the plurality of roof panels being mounted along the corresponding pair of adjacent purlins from the plurality of purlins.

5. The arch building structure as claimed in claim 4 comprising:
each roof panel comprising a frame and a cover panel;
the cover panel being perimetrically positioned flush with the frame;
the cover panel being connected to the frame; and
the frame being mounted along the corresponding pair of adjacent purlins from the plurality of purlins.

6. The arch building structure as claimed in claim 1 comprising:
the first truss and the third truss each further comprising a left base chord, a left top chord, a right top chord, and a right base chord;
the left top chord and the right top chord being oppositely positioned of each other about the ridge connector;
the left top chord and the right top chord being angularly mounted to the ridge connector;
the left arch connector and the ridge connector being oppositely positioned of each other about the left top chord;
the left top chord being angularly mounted to the left arch connector;
the left base chord and the left top chord being oppositely positioned of each other about the left arch connector;
the left base chord being angularly mounted to the left arch connector;
the right arch connector and the ridge connector being oppositely positioned of each other about the right top chord;
the right top chord being angularly mounted to the right arch connector;
the right base chord and the right top chord being oppositely positioned of each other about the right arch connector; and
the right base chord being angularly mounted to the right arch connector.

7. The arch building structure as claimed in claim 6 comprising:
a first angle between the left top chord and the right top chord being an obtuse angle;
a second angle between the left top chord and the left base chord being an obtuse angle;
a third angle between the right top chord and the right base chord being an obtuse angle; and
the first angle, the second angle, and the third angle being equal to each other.

8. The arch building structure as claimed in claim 1 comprising:
the second truss further comprising a left base chord, a left top chord, a center top chord, a right top chord, and a right base chord;
the plurality of channeled arch connectors comprising a first connector, a first backplate, a second connector, a second backplate, a third connector, a third backplate, a fourth connector, and a fourth backplate;

the left base chord and the left top chord being oppositely positioned of the right top chord and the right base chord about the center top chord;

the center top chord being centrally positioned to the ridge connector;

the left base chord and the left top chord being oppositely positioned of each other about the first connector;

the left base chord and the left top chord being angularly mounted in between the first connector and the first backplate;

the first connector and the second connector being oppositely positioned of each other about the left top chord;

the left top chord being angularly mounted in between the second connector and the second backplate;

the center top chord and the left top chord being oppositely positioned of each other about the second connector;

the center top chord being angularly mounted in between the second connector and the second backplate;

the second connector and the third connector being oppositely positioned of each other about the left top chord;

the center top chord being angularly mounted in between the third connector and the third backplate;

the right top chord being angularly mounted in between the third connector and the third backplate;

the third connector and the fourth connector being oppositely positioned of each other about the right top chord;

the right top chord being angularly mounted in between the fourth connector and the fourth backplate;

the right base chord and the right top chord being oppositely positioned of each other about the fourth connector; and the right base chord being angularly mounted in between the fourth connector and the fourth backplate.

9. The arch building structure as claimed in claim 8 comprising:

a fourth angle between the left base chord and the left top chord being an obtuse angle;

a fifth angle between the left top chord and the center top chord being an obtuse angle;

a sixth angle between the center top chord and the right top chord being an obtuse angle;

a seventh angle between the right top chord and the right base chord being an obtuse angle; and the fourth angle, the fifth angle, the sixth angle, and the seventh angle being equal to each other.

10. The arch building structure as claimed in claim 1 comprising:

a set of purlin connectors;

the set of purlin connectors being equally spaced along each of the plurality of purlins;

the set of purlin connectors being externally mounted to each of the plurality of purlins;

the set of purlin connectors of the ridge purlin being mounted to the central notch of the ridge connector of the of the first truss and the third truss;

the set of purlin connectors of the first left purlin, the third left purlin, the first right purlin, and the third right purlin being mounted to the central notch of the plurality of channeled arch connectors of the second truss; and the set of purlin connectors of the second left purlin and the second right purlin being mounted to the central notch of the left arch connector and the central notch of the right arch connector of the first truss and the third truss.

11. The arch building structure as claimed in claim 10 comprising:

each of the plurality of structural arch assemblies comprising a left anchor base and a right anchor base;

the plurality of purlins comprising a left base purlin and a right base purlin;

the set of purlin connectors of the left base purlin being mounted to the left anchor base; and the set of purlin connectors of the right base purlin being mounted to the right anchor base.

* * * * *